US010403208B2

(12) United States Patent
Kwon et al.

(10) Patent No.: US 10,403,208 B2
(45) Date of Patent: Sep. 3, 2019

(54) EMISSION DRIVER AND DISPLAY DEVICE INCLUDING THE SAME

(71) Applicant: SAMSUNG DISPLAY CO., LTD., Yongin-si, Gyeonggi-do (KR)

(72) Inventors: Tae-Hoon Kwon, Yongin-si (KR); Seung-Kyu Lee, Asan-si (KR); Seung-Ji Cha, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 526 days.

(21) Appl. No.: 15/139,184

(22) Filed: Apr. 26, 2016

(65) Prior Publication Data

US 2017/0116920 A1 Apr. 27, 2017

(30) Foreign Application Priority Data

Oct. 26, 2015 (KR) ..... 10-2015-0148508

(51) Int. Cl.
*G09G 3/3266* (2016.01)

(52) U.S. Cl.
CPC ... *G09G 3/3266* (2013.01); *G09G 2300/0861* (2013.01); *G09G 2310/0286* (2013.01)

(58) Field of Classification Search
CPC ..... G09G 3/3266; G09G 2300/0861; G09G 2310/0286
See application file for complete search history.

(56) References Cited

U.S. PATENT DOCUMENTS

2005/0083292 A1* 4/2005 Moon ..... G09G 3/3685 345/100
2015/0002377 A1* 1/2015 Liu ..... G09G 3/3258 345/77

FOREIGN PATENT DOCUMENTS

KR 10-2011-0037537 4/2011

* cited by examiner

*Primary Examiner* — Sahlu Okebato
(74) *Attorney, Agent, or Firm* — Lewis Roca Rothgerber Christie LLP

(57) ABSTRACT

An emission driver includes light emission control drivers electrically connected to light emission control lines, the light emission control drivers including an (n−1)th light emission control driver configured to provide an (n−1)th carry signal, n being an integer greater than or equal to 2, and an (n)th light emission control driver adjacent to the (n−1)th light emission control driver, the (n)th light emission control drive being configured to generate an (n)th light emission control signal for controlling a light emission time of a pixel based on the (n−1)th carry signal, and to generate an (n)th carry signal based on the (n)th light emission control signal.

19 Claims, 5 Drawing Sheets

EMISSION DRIVER AND DISPLAY DEVICE INCLUDING THE SAME

CROSS-REFERENCE TO RELATED APPLICATION

This application claims priority to and the benefit of Korean Patent Application No. 10-2015-0148508, filed on Oct. 26, 2015 in the Korean Intellectual Property Office (KIPO), the content of which is incorporated herein in its entirety by reference.

BACKGROUND

1. Field

Aspects of the present inventive concept relate to a display device

2. Description of the Related Art

An organic light emitting display device displays an image using organic light emitting diodes to emit light by recombination of electrons and holes.

The organic light emitting display device includes pixels that emit light in response to data signals and an emission driver that controls a light emission time of the pixels. Although some of the pixels emit light in response to the same data signal, these pixels may represent different grayscale values according to a light emission time (or a change of the light emission time). Therefore, the organic light emitting display device may represent a variety of grayscale values by controlling the light emission time of the pixels.

The above information disclosed in this Background section is for enhancement of understanding of the background of the invention and therefore it may contain information that does not form the prior art.

SUMMARY

Aspects of embodiments of the present inventive concept are directed to an emission driver capable of finely controlling a light emission time of the pixels of a display device.

Aspects of embodiments of the present inventive concept are directed to a display device including the emission driver.

According to some embodiments of the present invention, there is provided an emission driver including: light emission control drivers electrically connected to light emission control lines, the light emission control drivers including: an (n−1)th light emission control driver configured to provide an (n−1)th carry signal, n being an integer greater than or equal to 2; and an (n)th light emission control driver adjacent to the (n−1)th light emission control driver, the (n)th light emission control drive being configured to generate an (n)th light emission control signal for controlling a light emission time of a pixel based on the (n−1)th carry signal, and to generate an (n)th carry signal based on the (n)th light emission control signal.

In an embodiment, the (n)th light emission control driver includes: a first circuit configured to generate the (n)th light control signal based on the (n−1)th carry signal, a first clock signal, and a second clock signal having a first phase with respect to the first clock signal, the (n−1)th carry signal having a first period; and a second circuit configured to generate the (n)th carry signal based on the (n)th light emission control signal, the first clock signal, and the second signal, wherein the (n)th carry signal is shifted by the first period with respect to the (n−1)th carry signal.

In an embodiment, the first circuit is configured to generate the (n)th light emission control signal by shifting the (n−1)th carry signal by an amount corresponding to the first phase.

In an embodiment, the second circuit includes: a first pull-down block configured to store the (n)th light emission control signal at a first node in response to the second clock signal and to pull-down a level of the (n)th carry signal to be equal to that of the first clock signal based on a first voltage at the first node; and a first pull-up block configured to store a low voltage at a second node in response to the second clock signal, and to output the (n)th carry signal having a high voltage based on a second voltage at the second node.

In an embodiment, the first pull-down block includes: a first transistor including a first electrode configured to receive the (n)th light emission control signal, a second electrode electrically connected to the first node, and a gate electrode configured to receive the second clock signal; a seventh transistor including a first electrode configured to receive the first clock signal, a second electrode electrically connected to an output terminal and configured to output the (n)th carry signal, and a gate electrode electrically connected to the first node; and a first capacitor electrically connected between the first node and the output terminal.

In an embodiment, the first pull-down block further includes: a second transistor including a first electrode electrically connected to the high voltage, a second electrode electrically connected to a third node, and a gate electrode electrically connected to the second node; and a third transistor including a first electrode electrically connected to the third node, a second electrode electrically connected to the first node, and a gate electrode configured to receive the first clock signal.

In an embodiment, the first pull-up block includes: a fifth transistor including a first electrode electrically connected to the second node, a second electrode electrically connected to the low voltage, and a gate electrode configured to receive the second clock signal; a sixth transistor including a first electrode configured to receive the high voltage, a second electrode electrically connected to an output terminal configured to output the (n)th carry signal, and a gate electrode electrically connected to the second node; and a second capacitor electrically connected between the second node and the high voltage.

In an embodiment, the first pull-up block further includes: a fourth transistor including a first electrode electrically connected to the second node, a second electrode configured to receive the second clock signal, and a gate electrode electrically connected to the first node.

In an embodiment, the second circuit is the same as the first circuit.

In an embodiment, the first circuit includes: a second pull-down block configured to store the (n−1)th carry signal at a fourth node in response to the second clock signal, and to pull-down a voltage level of the (n)th light emission control signal to have a low voltage based on a fourth voltage at the fourth node; and a second pull-up block configured to provide a low voltage to a fifth node in response to the second clock signal, and to output the (n)th light emission control signal having a high voltage based on the first clock signal and a fifth voltage at the fifth node.

In an embodiment, the second pull-up block includes: a thirteenth transistor including a gate electrode configured to receive the second clock signal, a first electrode configured to receive a low voltage, and a second electrode electrically connected to the fifth node; a twelfth capacitor electrically connected between the fifth node and a sixth node; a sixteenth transistor including a gate electrode electrically connected to the fifth node, a first electrode configured to receive the first clock signal, and a second electrode electrically connected to the sixth node; a seventeenth transistor including a gate electrode configured to receive a first clock signal, a first electrode electrically connected to the sixth node, and a second electrode electrically connected to a seventh node; a nineteenth transistor including a gate electrode electrically connected to the seventh node, a first electrode configured to receive the high voltage, and a second electrode electrically connected to an output terminal configured to output the (n)th light emission control signal; and a thirteenth capacitor electrically connected between the seventh node and the first electrode of the nineteenth transistor.

In an embodiment, the second pull-up block further includes: a twelfth transistor including a gate electrode electrically connected to the second node, a first electrode configured to receive the second clock signal, and a second electrode electrically connected to the fifth node; and an eighteenth transistor including a gate electrode electrically connected to the second node, a first electrode configured to receive a low voltage, and a second electrode electrically connected to the seventh node.

In an embodiment, the second pull-down block includes: an eleventh transistor including a gate electrode configured to receive the second clock signal, a first electrode configured to receive the (n−1)th carry signal, and a second electrode electrically connected to the fourth node; a fourteenth transistor including a gate electrode configured to receive the first clock signal, a first electrode electrically connected to the fifth node, and a second electrode electrically connected to the fourth node; an eleventh capacitor electrically connected between the fourth node and the first clock signal; and a twentieth transistor including a gate electrode electrically connected to the fourth node, a first electrode configured to receive the low voltage, and a second electrode electrically connected to an output terminal configured to output the (n)th light emission control signal.

In an embodiment, the eleventh capacitor is a MOS capacitor.

In an embodiment, the eleventh capacitor includes: a first electrode electrically connected to the first clock signal; a second electrode electrically connected to the first clock signal; and a gate electrode electrically connected to the fourth node.

According to some embodiments of the present invention, there is provided a display device including: a display panel including light emission control lines and pixels; and an emission driver including light emission control drivers electrically connected to the light emission control lines, the light emission control drivers including: an (n−1)th light emission control driver configured to provide an (n−1)th carry signal, n being an integer greater than or equal to 2; and an (n)th light emission control driver adjacent to the (n−1)th light emission control driver, the (n)th light emission control drive being configured to generate an (n)th light emission control signal for controlling a light emission time of the pixels based on the (n−1)th carry signal, and to generate an (n)th carry signal based on the (n)th light emission control signal.

In an embodiment, the (n)th light emission control driver includes: a first circuit configured to generate the (n)th light control signal based on the (n−1)th carry signal, a first clock signal, and a second clock signal having a first phase with respect to the first clock signal, the (n−1)th carry signal having a first period; and a second circuit configured to generate the (n)th carry signal based on the (n)th light emission control signal, the first clock signal, and the second signal, wherein the (n)th carry signal is shifted by the first period with respect to the (n−1)th carry signal.

In an embodiment, the second circuit includes: a first pull-down block configured to store the (n)th light emission control signal at a first node in response to the second clock signal and to pull-down a level of the (n)th carry signal to be equal to that of the first clock signal based on a first voltage at the first node; and a first pull-up block configured to store a low voltage at a second node in response to the second clock signal and to output the (n)th carry signal having a high voltage based on a second voltage at the second node.

In an embodiment, the first pull-down block includes: a first transistor including a first electrode configured to receive the (n)th light emission control signal, a second electrode electrically connected to the first node, and a gate electrode configured to receive the second clock signal; a seventh transistor including a first electrode configured to receive the first clock signal, a second electrode electrically connected to an output terminal and configured to output the (n)th carry signal, and a gate electrode electrically connected to the first node; and a first capacitor electrically connected between the first node and the output terminal.

In an embodiment, the first pull-up block includes: a fifth transistor including a first electrode electrically connected to the second node, a second electrode electrically connected to the low voltage, and a gate electrode configured to receive the second clock signal; a sixth transistor including a first electrode configured to receive the high voltage, a second electrode electrically connected to an output terminal configured to output the (n)th carry signal, and a gate electrode electrically connected to the second node; and a second capacitor electrically connected between the second node and the high voltage.

Therefore, an emission driver according to example embodiments of the present inventive concept may finely control a light emission control signal by generating an (n)th light emission control signal and an (n)th carry signal.

Further, a display device according to example embodiments of the present inventive concept may finely control a light emission time of pixels of the display panel by including the emission driver.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Hereinafter, the present inventive concept will be explained in detail with reference to the accompanying drawings.

Figure 1:
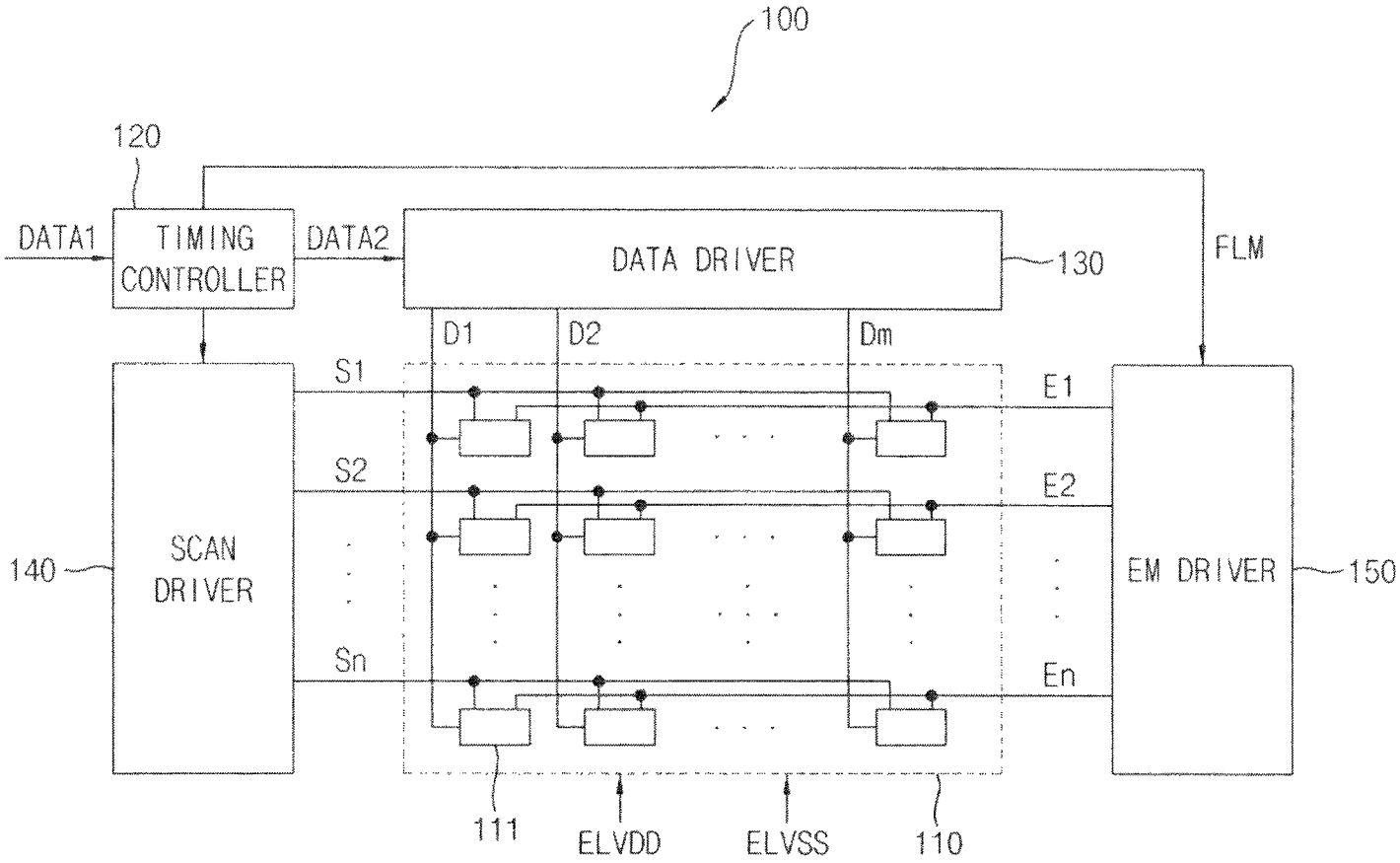
FIG. 1 is a block diagram illustrating a display device according to some example embodiments of the present inventive concept.

FIG. 1 is a block diagram illustrating a display device according to some example embodiments of the present inventive concept.

Referring to FIG. 1, the display device 100 may include a display panel 110, a timing controller 120, a data driver 130, a gate driver 140, and an emission driver 150. The display device 100 may display an image based on image data provided from outside or an external device. For example, the display device 100 may be an organic light emitting display device.

The display panel 110 may include scan lines S1 through Sn, data lines D1 through Dm, light emission control lines E1 through En, and pixels 111, where each of m and n is an integer greater than or equal to 2. The pixels 111 may be disposed at crossing regions of the scan lines S1 through Sn and the data lines D1 through Dm. Each of the pixels 111 may store a data signal in response to a scan signal, and may emit light based on a stored data signal.

The timing controller 120 may control the data driver 130, the scan driver 140, and the emission driver 150. The timing controller 120 may generate a scan driving control signal, a data driving control signal and a light emission control signal, and may control the data driver 130, the scan driver 140, and the emission driver 150 based on generated signals. Here, the light emission control signal may include a start signal, a first clock signal, and a second clock signal. The start signal may be used to determine a light emission time or a light non-emission time (or an off duty ratio) of pixels 111. For example, the light non-emission time of the pixel 111 may be determined according to a time in which the start signal has a logic high level (e.g., a logic state of 1, a first voltage, a high voltage level, or a turn-off voltage, etc.). The first clock signal may be a pulse signal, which is a basis of an operation timing of the display device 100. For example, the first clock signal may be a square wave, which periodically oscillates between the logic high level and a logic low level (e.g., a logic state of 0, a second voltage, a low voltage level, or a turn-off voltage, etc.). The second clock signal may be a square wave that has a phase difference (or, a first phase difference) with respect to the first clock signal. For example, the second clock signal may have a period (e.g., a first period) that is the same or substantially the same as a period of the first clock signal, and may be shifted by a half of the period of the first clock signal with respect to the first clock signal. For example, the second clock signal may be an inversed signal of the first clock signal.

The data driver 130 may generate data signals based on image data (e.g., a second data DATA2). The data driver 130 may provide the data signals to the display panel 110 in response to the data driving control signal. The data driver 130 may provide the data signals to the pixels 111 through the data lines D1 through Dm.

The scan driver 140 may generate the scan signal based on the scan driving control signal. The scan driving control signal may include a start pulse and clock signals, and the scan driver 140 may include a shift register for sequentially generating the scan signal corresponding to the start pulse and the clock signals.

The emission driver (or, EM driver) 150 may receive a light emission driving control signal from the timing controller to generate the light emission control signal. The emission driver 150 may provide the light emission control signal to the pixel 111 through the light emission control lines E1 through En.

In some example embodiments, the emission driver 150 may include light emission control driving units (e.g., light emission control drivers), which are electrically connected to the light emission control lines E1 through En. An (n)th light emission control driving unit (e.g., an (n)th light emission control driver) among the light emission control driving units may generate an (n)th light emission control signal based on an (n−1)th carry signal, and may generate an (n)th carry signal based on the (n)th light emission control signal. Here, the (n−1)th carry signal may be generated by (or, provided from) an (n−1)th light emission control driving unit adjacent to the (n)th light emission control driving unit. The (n)th carry signal may be shifted with respect to the (n−1)th carry signal by a certain time (e.g., by the period of the first clock signal). Therefore, the emission driver 150 may control the light emission control signal for each of the pixels based on the certain time (e.g., the period of the first clock signal).

It is illustrated in FIG. 1 that the emission driver 150 is implemented independently of (e.g., implemented to be separate from) the scan driver 140. However, the emission driver 150 is not limited thereto. For example, the emission driver 150 may be implemented in or be integrated with the scan driver 140.

As described above, the display device 100 may generate the (n)th light emission control signal, which is shifted by a certain time (e.g., by a period of a clock signal) with respect to the (n−1)th light emission control signal, based on the (n−1)th carry signal (i.e., the (n−1)th carry signal that is generated after the (n−1)th light emission control signal is generated, and which has a certain phase difference with respect to the (n−1)th light emission control signal). Therefore, the display device 100 may control the light emission control signal with a certain time (e.g., a period of the clock signal) as a minimum control time unit.

Figure 2:
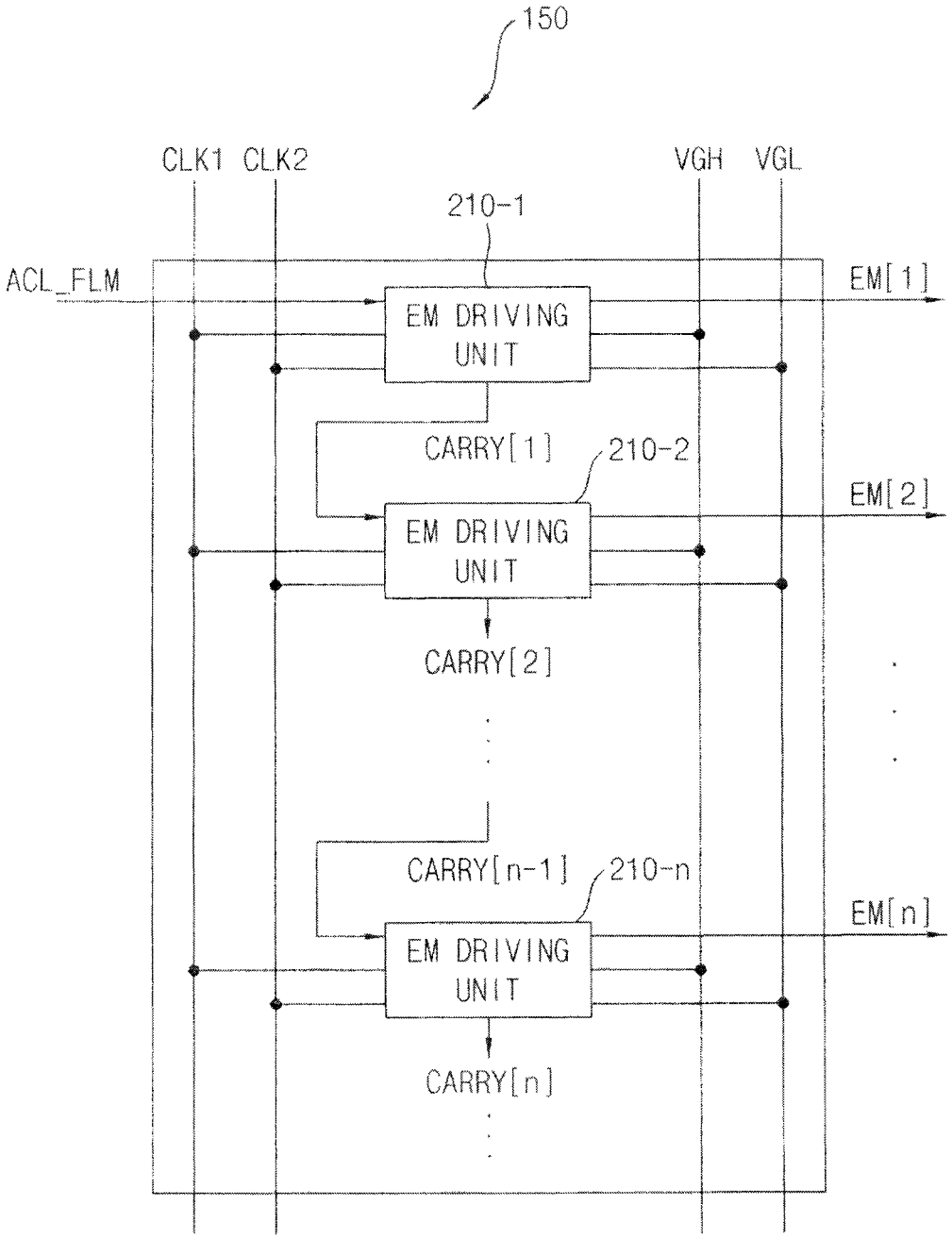
FIG. 2 is a block diagram illustrating an example of an emission driver included in the display device of FIG. 1.
Figure 3:
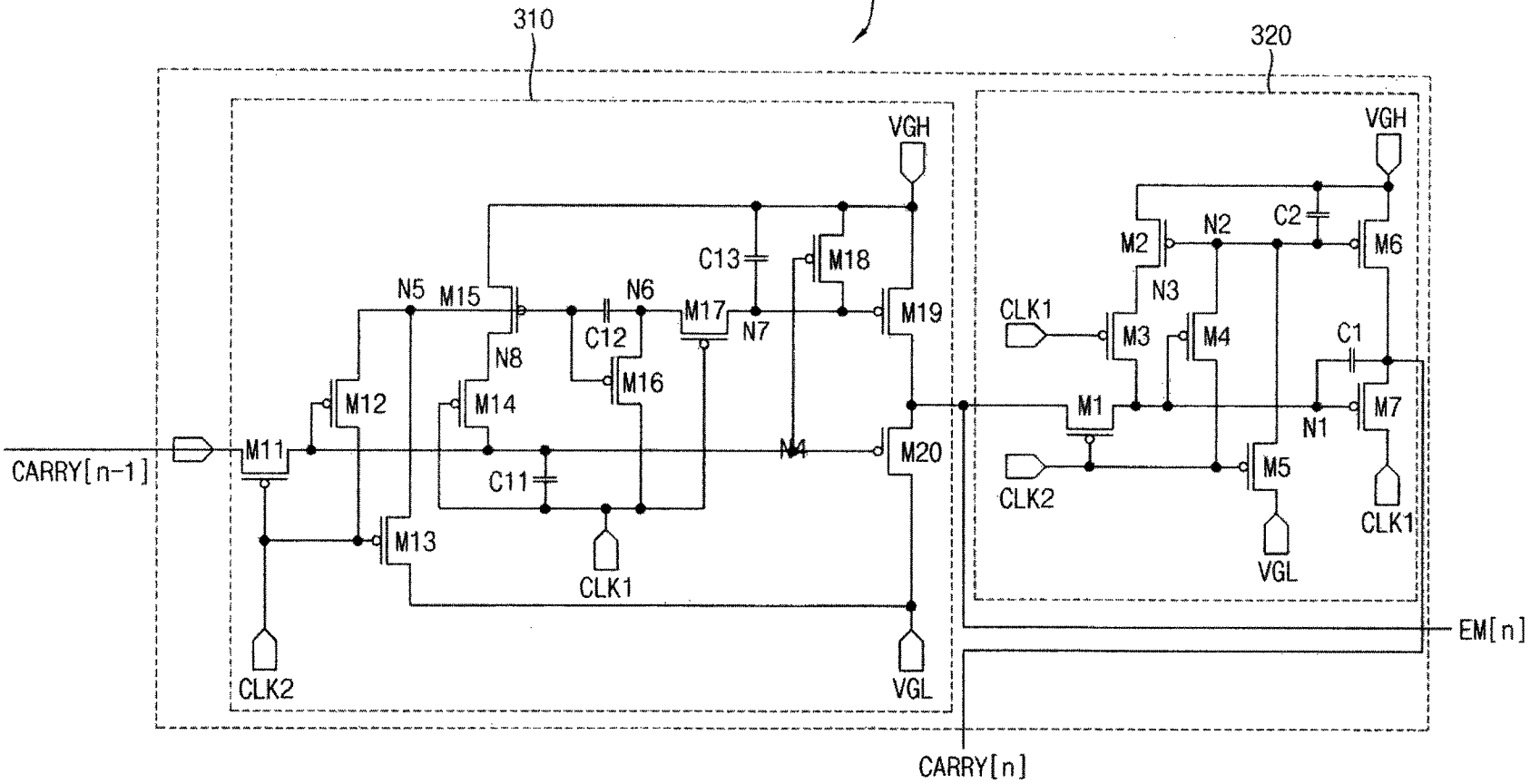
FIG. 3 is a circuit diagram illustrating an example of a light emission control driving unit included in the emission driver of FIG. 2.

FIG. 2 is a block diagram illustrating an example of an emission driver included in the display device of FIG. 1. FIG. 3 is a circuit diagram illustrating an example of a light emission control driving unit included in the emission driver of FIG. 2.

Referring to FIGS. 2 and 3, the emission driver 150 may include light emission control lines and light emission control driving units 210-1 through **210-*n***, where n is a positive integer.

Each of the light emission control driving units 210-1 through **210-*n* may receive a start signal ACL_FLM, a first clock signal EM_CLK1 (also referred to as "CLK1" in the drawings), a second clock signal EM_CLK2 (also referred to as "CLK2" in the drawings), a first voltage VGH, and a second voltage VGL. Here, the start signal ACL_FLM, a first clock signal EM_CLK1, and a second clock signal EM_CLK2 are the same or substantially the same as the start signal, the first clock signal, and the second signal described with respect to FIG. 1**, respectively.

A first light emission control driving unit 210-1 may generate a first light emission control signal EM1 and a first carry signal CARRY[1] based on a first start signal FLM1. A second light emission control driving unit 210-2 may generate a second light emission control signal EM2 based on the first carry signal CARRY[1]. An (n)th light emission control driving unit **210-*n*** may generate an (n)th light emission control signal EM[n] based on an (n−1)th carry signal CARRY[n−1].

The (n)th light emission control driving unit **210-*n* may include a first circuit (e.g., a light emission control signal generator) 310, which generates the (n)th light emission control signal EM[n] in response to the (n−1)th carry signal CARRY[n−1], the first clock signal EM_CLK1, and the second clock signal EM_CLK2. The (n)th light emission control driving unit 210-*n* may include a second circuit (e.g., a buffer) 320, which generates the (n)th carry signal CARRY[n] based on the (n)th light emission control signal EM[n], the first clock signal EM_CLK1, and the second clock signal EM_CLK2**.

In some example embodiments, the second circuit 320 may include a first pull-down block and a first pull-up block. The first pull-down block may store the (n)th light emission control signal EM[n] at a first node N1 (e.g., store in a first capacitor C1 at node N1) in response to the second clock signal EM_CLK2, and may pull-down the carry signal CARRY[n] to have (or, to be equal to) a level of the first clock signal EM_CLK1 based on a first voltage at the first node N1 (or, a node voltage at the first node N1). The first pull-up block may store a low voltage VGL in a second node N2 (e.g., store in a second capacitor C2 at node N2) in response to the first clock signal EM_CLK1, and may output the (n)th carry signal CARRY[n], which has a high voltage VGH, based on a second voltage at the second node N2 (or, a node voltage at the second node N2).

For reference, the second circuit 320 may be conceptually divided into the first pull-down block and the first pull-up block, based on the logic state (e.g., the logic high level or the logic low level) of the (n)th light emission control signal EM[n].

In some example embodiments, the first pull-down block may include a first transistor M1, a seventh transistor M7, and the first capacitor C1.

The first transistor M1 may include a first electrode that receives the (n)th light emission control signal EM[n], a second electrode that is electrically connected to the first node N1, and a gate electrode that receives the second clock signal EM_CLK2. The first transistor M1 may transfer the (n)th light emission control signal EM[n] to the first node N1 in response to the second clock signal EM_CLK2.

The first capacitor C1 may be electrically connected between the first node N1 and an output terminal of the second circuit 320. The first capacitor C1 may store the (n)th light emission control signal EM[n] provided to the first node N1. The first capacitor C1 may boost (or, capacitor-boost) the first node N1 based on a voltage at the output terminal (i.e., the output terminal of the second circuit 320), which outputs the (n)th carry signal CARRY[n].

The seventh transistor M7 may include a first electrode that receives the first clock signal EM_CLK1, a second electrode that is electrically connected to the output terminal of the second circuit 320, and a gate electrode that is electrically connected to the first node N1. The seventh transistor M7 may pull-down the (n)th carry signal CARRY[n] to have (or, to be equal to) a level of the first clock signal EM_CLK1 in response to the first voltage at the first node N1 (i.e., the node voltage at the first node N1).

Therefore, the first pull-down block may output the (n)th carry signal CARRY[n] having a waveform that is the same as or substantially the same as a waveform of the first clock signal EM_CLK1.

In some example embodiments, the first pull-down block may further include a second transistor M2 and a third transistor M3.

The second transistor M2 may include a first electrode that is electrically connected to the high voltage VGH (or, which receives the high voltage VGH), a second electrode that electrically connected to a third node N3, and a gate electrode that is electrically connected to the second node N2. The third transistor M3 may include a first electrode that is electrically connected to the third node N3, a second electrode that is electrically connected to the first node N1, and a gate electrode that receives the first clock signal EM_CLK1. The second transistor M2 and the third transistor M3 may provide the high voltage VGH to the first node N1 in response to the second voltage at the second node N2 (or, a node voltage at the second node N2) and the first clock signal EM_CLK1. Here, the seventh transistor M7 may be turned off in response to the high voltage VGH.

In some example embodiments, the first pull-up block may include a fifth transistor M5, a sixth transistor M6, and a second capacitor C2.

The fifth transistor M5 may include a first electrode that is electrically connected to the second node N2, a second electrode that is electrically connected to the low voltage VGL (or, which receives the low voltage VGL), and a gate electrode that receives the second clock signal EM_CLK2. The fifth transistor M5 may provide the low voltage VGL to the second node N2 in response to the second clock EM_CLK2.

The second capacitor C2 may be electrically connected between the second node N2 and the high voltage VGH. The second capacitor C2 may store the low voltage VGL provided to the second node N2.

The sixth transistor M6 may include a first electrode that receives the high voltage VGH, a second electrode that is electrically connected to an output terminal of the second circuit 320, which outputs the (n)th carry signal CARRY[n], and a gate electrode that is electrically connected to the second node N2. The sixth transistor M6 may output the (n)th carry signal CARRY[n], which has (or, which is equal to) a level of the high voltage VGH in response to the second voltage at the second node N2 (or, the node voltage at the second node N2).

Therefore, the first pull-up block may output the (n)th carry signal CARRY[n] having the logic high level.

In some example embodiments, the first pull-up block may further include a fourth transistor M4. The fourth transistor M4 may include a first electrode that is electrically connected to the second node N2, a second electrode that receives the second clock signal EM_CLK2, and a gate electrode that is electrically connected to the first node N1. The fourth transistor M4 may provide a second clock signal EM_CLK2 to the second node N2 in response to the first voltage at the first node N1 (or, the node voltage at the first node N1). Therefore, the first pull-up block may not operate pulling-up performance during the first pull-down block operates (i.e., during the first pull-down block outputs the (n)th carry signal CARRY[n] having the logic low level).

The first circuit 310 may include a second pull-down block and a second pull-up block. The second pull-down block may store the (n−1)th carry signal CARRY[n−1] in a fourth node N4 in response to the second clock signal EM_CLK2, and may pull-down the (n)th light emission control signal EM[n] to have a level of the low voltage VGL based on a fourth voltage at the fourth node N4 (i.e., a node voltage at the fourth node N4). The second pull-up block may provide the low voltage VGL to a fifth node N5 in response to the second clock signal EM_CLK2, and may output the (n)th light emission control signal EM[n] having the high voltage VGH based on a fifth voltage at the fifth node N5 (i.e., a node voltage at the fifth node N5).

In some example embodiments, the second pull-up block may include a thirteenth transistor M13, a twelfth transistor M12, a seventeenth transistor M17, a nineteenth transistor M19, and a eighteenth transistor M18.

The thirteenth transistor M13 may include a gate electrode that receives the second clock signal EM_CLK2, a first electrode that receives the low voltage VGL, and a second electrode that is electrically connected to the fifth node N5.

The thirteenth transistor M13 may charge the fifth node N5 with the low voltage VGL in response to the second clock signal EM_CLK2. The twelfth capacitor C12 may be electrically connected between the fifth node N5 and a sixth node N6. The twelfth capacitor C12 may couple (or, capacitively couple) the fifth node N5 and the sixth node N6. The sixteenth transistor M16 may include a gate electrode that is electrically connected to the fifth node N5, a first electrode that receives the first clock signal EM_CLK1, and a second electrode that is electrically connected to the sixth node N6. The sixteenth transistor M16 may provide the first clock signal to the sixth node N6 in response to a fifth voltage at the fifth node N5 (i.e., a node voltage at the fifth node N5). The seventeenth transistor M17 may include a gate electrode that receives the first clock signal EM_CLK1, a first electrode that is electrically connected to the sixth node N6, and a second electrode that is electrically connected to a seventh node N7. The seventeenth transistor M17 may connect (e.g., diode-connect) the sixth node N6 and the seventh node N7 in response to the first clock signal EM_CLK1. The nineteenth transistor M19 may include a gate electrode that is electrically connected to the seventh node N7, a first electrode that receives (or, which is electrically connected to) the high voltage VGH, and a second electrode that is electrically connected to an output terminal of the first circuit 310, which outputs the (n)th light emission control signal EM[n]. The nineteenth transistor M19 may output the (n)th light emission control signal EM[n] having the high voltage VGH in response to a seventh voltage at the seventh node N7 (i.e., a node voltage at the seventh node N7). The thirteenth capacitor C13 may be electrically connected between the seventh node N7 and the first electrode of the nineteenth transistor M19. The thirteenth capacitor C13 may store (or, charge) a voltage provided to the seventh node N7. The thirteenth capacitor C13 may keep the nineteenth transistor M19 in a turn-on state based on a stored voltage (or, charged voltage).

Therefore, the second pull-up block may output the (n)th light emission control signal EM[n] having the logic high level.

In some example embodiments, the second pull-up block may further include a twelfth transistor M12 and an eighteenth transistor M18. The twelfth transistor M12 may include a gate electrode that is electrically connected to the fourth node N4, a first electrode that receives the second clock signal EM_CLK2, and a second electrode that is electrically connected to the fifth node N5. The twelfth transistor M12 may provide the second clock signal EM_CLK2 to the fifth node N5 in response to a fourth voltage at the fourth node N4 (i.e., a node voltage at the fourth node N4). The eighteenth transistor M18 may include a gate electrode that is electrically connected to the fourth node N4, a first electrode that receives the high voltage VGH, and a second electrode that is electrically connected to a seventh node N7. The eighteenth transistor M18 may provide the high voltage VGH to the seventh node N7 in response to a fourth voltage at the fourth node N4 (i.e., a node voltage at the fourth node N4). Here, the nineteenth transistor M19 may be turned off in response to the high voltage VGH.

In some example embodiments, the second pull-down block may include a eleventh transistor M11, a fifteenth transistor M15, a fourteenth transistor M14, a eleventh capacitor C11, and a twentieth transistor M20. The eleventh transistor M11 may include a gate electrode that receives the second clock signal EM_CLK2, a first electrode that receives the (n−1)th carry signal CARRY[n−1], and a second electrode that is electrically connected to the fourth node N4. The eleventh transistor M11 may provide the (n−1)th carry signal CARRY[n−1] to the fourth node N4 in response to the second clock signal EM_CLK2. The fifteenth transistor M15 may include a gate electrode that is electrically connected to the fifth node N5, a first electrode that receives the high voltage VGH, and a second electrode that is electrically connected to the eighth node N8. The fourteenth transistor M14 may include a gate electrode that receives the first clock signal EM_CLK1, a first electrode that is electrically connected to the eighth node N8, and a second electrode that is electrically connected to the fourth node N4. The fourteenth transistor M14 and the fifteenth transistor M15 may provide the high voltage VGH to the fourth node N4 in response to a fifth voltage at the fifth node N5 (i.e., a node voltage at the fifth node N5) and the first clock signal EM_CLK1. The eleventh capacitor C11 may be electrically connected between the fourth node N4 and the first clock signal EM_CLK1. The eleventh capacitor C11 may couple (or, capacitively couple, or connect) the fourth node N4 and a terminal which receives the first clock signal EM_CLK1. The twentieth transistor M20 may include a gate electrode that is electrically connected to the fourth node N4, a first electrode that receives the low voltage VGL, and a second electrode that is electrically connected to an output terminal which outputs the (n)th light emission control signal EM[n]. The twentieth transistor M20 may pull down the (n)th light emission control signal EM[n] to have the low voltage VGL in response to a fourth voltage at the fourth node N4 (i.e., a node voltage at the fourth node N4).

In some example embodiments, the eleventh capacitor C11 may be implemented as a MOS capacitor. For example, the eleventh capacitor C11 may be implemented as a PMOS transistor. The eleventh capacitor C11 may include a first electrode that is electrically connected to the first clock signal EM_CLK1, a second electrode that is electrically connected to the first clock signal EM_CLK1, and a gate electrode that is electrically connected to the fourth node N4. The eleventh capacitor C11 may perform a coupling operation based on the fourth voltage at the fourth node N4 (i.e., a node voltage at the fourth node N4). The eleventh capacitor C11 may operate as a capacitor when the fourth voltage at the fourth node N4 (i.e., the node voltage at the fourth node N4) has logic low level, and the eleventh capacitor C11 may operate as no capacitor when the fourth voltage at the fourth node N4 (i.e., the node voltage at the fourth node N4) has the logic high level. Here, power consumption of the first circuit 310 may be reduced because the eleventh capacitor C11 does not charge (e.g., store) the fourth voltage, which has the logic high level, at the fourth node N4 (i.e., the node voltage at the fourth node N4).

It is illustrated in FIG. 3 that transistors included in the emission driver 150 are P-type transistors (i.e., PMOS transistors). However, the transistors are not limited thereto. For example, each of the transistors may be an N-type transistor (i.e., an NMOS transistor).

In FIG. 3, the first circuit 310 and the second circuit 320 are illustrated by way of example. However, the first circuit 310 and the second circuit 320 are not limited thereto. For example, the first circuit 310 may be implemented as a shift resistor, which has a function to generate the (n)th light emission control signal EM[n] based on the (n−1)th carry signal CARRY[n−1]. For example, the second circuit 320 may include a configuration of the first circuit 310.

As described above, the (n)th light emission control driving unit 210-*n* may generate the (n)th light emission control signal EM[n] in response to the (n−1)th carry signal CARRY[n−1], the first clock signal EM_CLK1, and the second clock signal EM_CLK2, and may generate the (n)th carry signal CARRY[n] based on the (n)th light emission control signal EM[n], the first clock signal EM_CLK1, and the second clock signal EM_CLK2. Therefore, the (n)th light emission control driving unit 210-*n* may output the (n)th carry signal CARRY[n], which is shifted by one period (e.g., 1 horizontal time period (H)) of the first clock signal EM_CLK1 with respect to the (n−1)th carry signal CARRY [n−1].

Figure 4A:
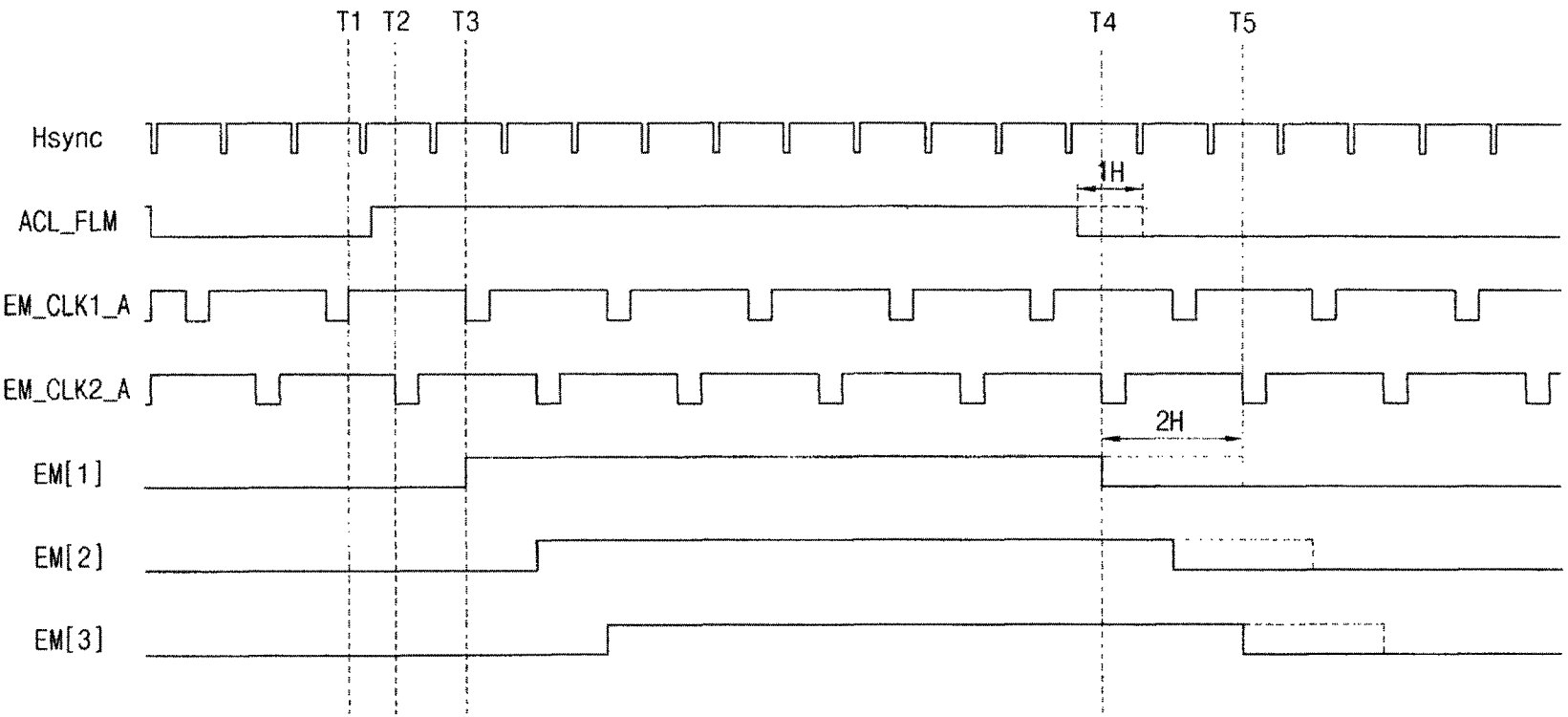
FIG. 4A is a waveform diagram illustrating a comparative example of a light emission control signal generated by the emission driver of FIG. 2.

FIG. 4A is a waveform diagram illustrating a comparative example of a light emission control signal generated by the emission driver of FIG. 2.

Figure 4B:
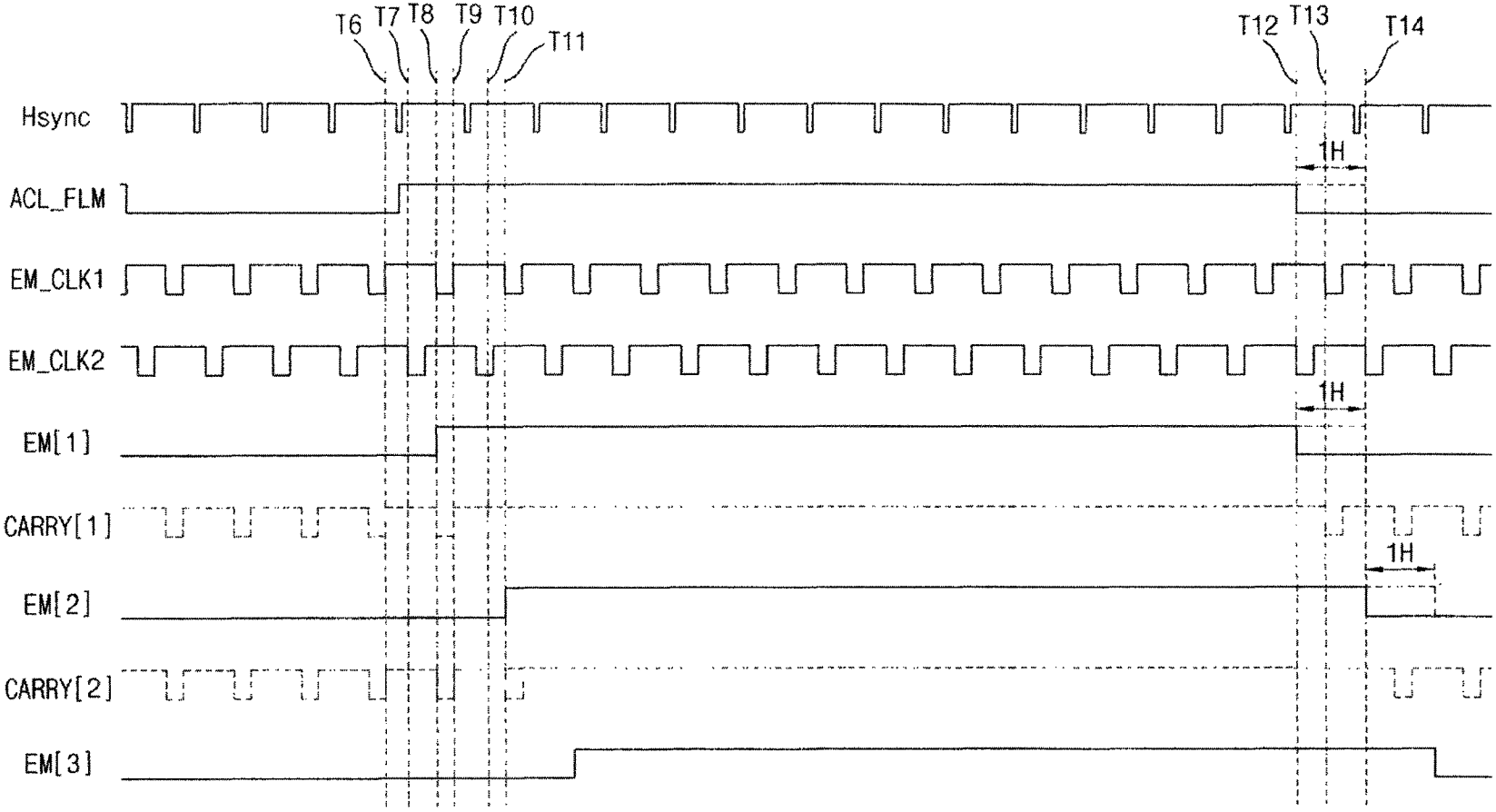
FIG. 4B is a waveform diagram illustrating an example of a light emission control signal generated by the emission driver of FIG. 2.

FIG. 4B is a waveform diagram illustrating an example of a light emission control signal generated by the emission driver of FIG. 2.

Referring to FIGS. 2, 3, and 4A, light emission control signals EM[1], EM[2], and EM[3] illustrated in FIG. 4A may be generated by the emission driver 150, which do not include the second circuit 320. Here, the (n)th light emission control driving unit 210-*n* included in the emission driver 150 may receive the (n−1)th light emission control signal EM[n−1] of the (n−1)th light emission control driving unit 210-*n*-1 as the (n−1)th carry signal CARRY[n−1]. A start signal ACL_FLM is provided to the first light emission control driving unit 210-1, and the start signal ACL_FLM may be in correspondence with the (n−1)th carry signal CARRY[n−1]. A first comparison clock signal EM_CLK1_A and a second comparison clock signal EM_CLK2_A may be the same or substantially the same as the first clock signal EM_CLK1 and the second clock signal EM_CLK2. However, a period of the first comparison clock signal EM_CLK1_A and a period of the second comparison clock signal EM_CLK2 may be two horizontal time periods (2H).

At a first time T1, the start signal ACL_FLM may have the logic low level, the first comparison clock signal EM_CLK1_A may have the logic high level, and the second comparison clock signal EM_CLK2_A may have the logic high level.

In this case, the first light emission control driving unit 210-1 may output the first light emission control signal EM[1] having the logic low level in response to the start signal ACL_FLM having the logic low level. The second light emission control driving unit 210-2 may output the second light emission control signal EM[2] having the logic low level in response to the first light emission control signal EM[1] having the logic low level. The third light emission control driving unit 210-3 may output the third light emission control signal EM[3] having the logic low level in response to the second light emission control signal EM[2] having the logic low level.

At a second time T2, the start signal ACL_FLM may have the logic high level, the first comparison clock signal EM_CLK1_A may have the logic high level, and the second comparison clock signal EM_CLK2_A may have the logic low level.

In this case, the first circuit 310 included in the first light emission control driving unit 210-1 may provide the fourth node N4 with the start signal ACL_FLM having the logic high level in response to the second comparison clock signal EM_CLK2_A having the logic low level. Therefore, the first circuit 310 may not perform a pulling-down operation. In addition, the first circuit 310 may provide the low voltage VGL to the fifth node N5 in response to the second comparison clock signal EM_CLK2_A having the logic low level. However, the first circuit 310 may not perform a pulling-up operation because the seventeenth transistor M17 is turned off in response to the first comparison clock signal EM_CLK1_A having the logic high level. Therefore, the first circuit 310 may keep the level of first light emission control signal EM[1] to be equal to that of the first light emission control signal EM[1] at a prior time (e.g., at the first time T1). That is, the first light emission control driving unit 210-1 may output the first light emission control signal EM[1] having the logic low level.

At a third time T3, the start signal ACL_FLM may have the logic high level, the first comparison clock signal EM_CLK1_A may have the logic low level, and the second comparison clock signal EM_CLK2_A may have the logic high level.

In this case, the first circuit 310 included in the first light emission control driving unit 210-1 may perform a pulling-up operation in response to the first comparison clock signal EM_CLK1_A having the logic low level. The sixteenth transistor M16 included in the first circuit 310 may be turned-on in response to the fifth voltage at the fifth node N5 (i.e., the node voltage at the fifth node N5), and the first comparison clock signal EM_CLK1_A having the logic low level may be provided to the sixth node N6. The seventeenth transistor M17 may be turned on in response to the first comparison clock signal EM_CLK1_A having the logic low level. The nineteenth transistor M19 may be turned on in response to the logic low level (e.g., the first comparison clock signal EM_CLK1_A having the logic low level), which is transferred through the seventeenth transistor M17. Therefore, the first light emission control driving unit 210-1 may output the first light emission control signal EM[1] having the logic high level.

Until the first light emission control driving unit 210-1 receives the start signal ACL_FLM having the logic low level, the first light emission control driving unit 210-1 may output the first light emission control signal EM[1] having the logic high level.

Similarly, the second light emission control driving unit 210-2 and the third light emission control driving unit 210-3 may sequentially output light emission control signals (i.e., the second light emission control signal EM[2] and the third light emission control signal EM[3]) having the logic high level.

At a fourth time T4, the start signal ACL_FLM may have the logic low level, the first comparison clock signal EM_CLK1_A may have the logic high level, and the second comparison clock signal EM_CLK2_A may have the logic low level.

In this case, the first circuit 310 included in the first light emission control driving unit 210-1 may provide the fourth node N4 with the start signal ACL_FLM having the logic low level in response to the second comparison clock signal EM_CLK2_A. Therefore, the first light emission control driving unit 210-1 may perform a pulling-down operation and may output the first light emission control signal EM[1] having the logic low level.

If a time of the start signal ACL_FLM having the logic high level increases by one horizontal time period (1H), the first light emission control driving unit 210-1 may output the first light emission control signal EM[1] at a fifth time T5 instead of at the fourth time T4. Because the first light emission control driving unit 210-1 performs a pulling-down operation in response to the second comparison clock signal EM_CLK2_A having the logic low level. Therefore, the first light emission control driving unit 210-1 may control the first light emission control signal EM[1] for every two horizontal time period (2H) (i.e., a period of the second comparison clock signal EM_CLK2_A).

Similarly, if a time of the start signal ACL_FLM having the logic high level increases by one horizontal time period (1H), the second light emission control driving unit 210-2 and the third light emission control driving unit 210-3 may output the light emission control signals (i.e., the second light emission control signal EM[2] and the third light emission control signal EM[3]) having the logic high level during a time that increases by two horizontal time period (2H).

As described above, the emission driver 150 may control a light emission control signal (e.g., the [n]th light emission control signal EM[n]) for every two horizontal time period 2H when the emission driver 150 includes the first circuit 310 and not the second circuit 320.

The emission driver 150 according to example embodiments includes the second circuit 320, which generates a carry signal (e.g., the (n−1)th carry signal CARRY[n−1]) and may generate a light emission control signal (e.g., the (n)th light emission control signal EM[n]) in response to the carry signal (e.g., the (n−1)th carry signal CARRY[n−1]). Therefore, the emission driver 150 according to example embodiments may control the light emission control signal (e.g., the (n)th light emission control signal EM[n]) for every one horizontal time period (1H) (e.g., a period of the second clock signal EM_CLK2).

FIG. 4B is a waveform diagram illustrating an example of a light emission control signal generated by the emission driver of FIG. 2.

Referring to FIGS. 2, 3, and 4B, the start signal ACL_FLM is provided to the first light emission control driving unit 210-1, and the start signal ACL_FLM may be in correspondence with the (n−1)th carry signal CARRY[n−1].

An operation of the emission driver 150 during a sixth time T6 through a eighth time T8 may be the same as or similar to an operation of the emission driver 150 during the first time T1 through the third time T3 described with reference to FIG. 4A.

However, the emission driver 150 may output carry signals CARRY[1], CARRY[2], etc., having a waveform that is the same or substantially the same as a waveform of the first clock signal EM_CLK1 according to light emission control signals EM[1], EM[2], EM[3], etc., which have the logic low level. The second circuit 320 included in the emission driver may perform a pulling-down operation in response to the first light emission control signal EM[1] and may output the first carry signal CARRY[1] at a level equal to that of the first clock signal EM_CLK1.

At an eighth time T8, the emission driver 150 may output the first light emission control signal EM[1] having the logic high level. Here, the second circuit 320 included in the first light emission control driving unit 210-1 may receive the first light emission control signal EM[1] having the logic low level, however the first transistor M1 included in the second circuit 320 may keep a turned-off state in response to the second clock signal EM_CLK2 having the logic high level. Therefore, the second circuit 320 may output the first carry signal CARRY[1] having the logic low level.

At a ninth time T9, the second circuit 320 included in the first light emission control driving unit 210-1 may output the first carry signal CARRY[1] having the logic high level. The second circuit 320 may output the second clock signal EM_CLK2 as the first carry signal CARRY[1] and the second clock signal EM_CLK2 may be changed from the logic low level to the logic high level. Therefore, the second circuit 320 may output the first carry signal CARRY[1] having the logic high level.

At a tenth time T10, the first light emission control signal EM[1] may have the logic high level, the first clock signal EM_CLK1 may have the logic high level, and the second clock signal EM_CLK2 may have the logic low level. Here, the second circuit 320 included in the first light emission control driving unit 210-1 may output the first carry signal CARRY[1] having the logic high level. In the second circuit 320, the first transistor M1 may provide the first node N1 with the first light emission control signal EM[1] having the logic high level in response to the second clock signal EM_CLK2 having the logic low level. Therefore, the seventh transistor M7 in the second circuit 320 may be turned off, and the second circuit 320 may not perform a pulling-down operation. In addition, the fifth transistor M5 in the second circuit 320 may provide the low voltage VGL to the second node N2 in response to the second clock signal EM_CLK2 having the logic low level, and the sixth transistor M6 in the second circuit 320 may be turned on in response to the second voltage at the second node N2 (i.e., the node voltage at the second node N2). Therefore, the second circuit 320 may output the first carry signal CARRY [1] having the logic high level.

The low voltage VGL transferred to the second node N2 may be charged in the second capacitor C2. Therefore, the second circuit 320 may output the first carry signal CARRY [1] having the logic high level until the second circuit receives the first light emission control signal EM[1] having the logic low level.

Similarly, the second light emission control driving unit 210-2 and the third light emission control driving unit 210-3 may operate in the same or substantially the same manner as the first light emission control driving unit 210-1. Therefore, the second light emission control driving unit 210-2 may output the second light emission control signal EM[2] having the logic low level.

At a eleventh time T11, the second light emission control driving unit 210-2 may operate in the same or substantially the same manner as the first light emission control driving unit 210-1 at the eighth time T8. That is, the second light emission control driving unit 210-2 may output the second light emission control signal EM[2] having the logic high level and the second carry signal CARRY[2] having the logic low level.

As described above, the first light emission control driving unit 210-1 may shift the start signal ACL_FLM by a period of the first clock signal EM_CLK1 (e.g., 1H) and may output the first light emission control signal EM[1], which is the same or substantially the same as a shifted start signal ACL_FLM. In addition, the first light emission control driving unit 210-1 may output the first carry signal CARRY [1] having the logic high level in response to the first light emission control signal EM[1] having the logic high level and the first clock signal EM_CLK1 having the logic high level. The second light emission control driving unit 210-2 may shift the first light emission control signal EM[1] by the period of the first clock signal EM_CLK1 (e.g., 1H) in response to the first carry signal CARRY[1] and may output the second light emission control signal EM[2], which is the same or substantially the same as a shifted first light emission control signal EM[1].

Therefore, the emission driver 150 may sequentially output the light emission control signals EM[1], EM[2], EM[3], etc., which have the logic high level in response to the start signal ACL_FLM having the logic high level.

At a twelfth time T12, the first light emission control driving unit 210-1 may operate in the same or substantially the same manner as the first light emission control driving unit 210-1 at the fourth time T4. That is, the first light emission control driving unit 210-1 may output the first light emission control signal EM[1] having the logic low level. In addition, the first light emission control driving unit 210-1 may output the first carry signal CARRY[1] having the logic high level. That is, the second circuit 320 included in the first light emission control driving unit 210-1 may pull-down the level of first carry signal CARRY[1] to be equal to that of the first clock signal EM_CLK1 in response to the first light emission control signal EM[1]. Because the first clock signal has the logic high level, the first light emission control driving unit 210-1 may output the first carry signal CARRY [1] having the logic high level.

At a thirteenth time T13, the first light emission control driving unit 210-1 may output the first carry signal CARRY [1] having the logic low level. That is, the second circuit 320 included in the first light emission control driving unit 210-1 may pull down the level of first carry signal CARRY[1] to be equal to that of the first clock signal EM_CLK1 in response to the first light emission control signal EM[1]. Because the first clock signal EM_CLK1 has the logic low level, the first light emission control driving unit 210-1 may output the first carry signal CARRY[1] having the logic low level.

At a fourteenth time T14, the second light emission control driving unit 210-2 may operate in the same or substantially the same manner as the first light emission control driving unit 210-1 at the twelfth time T12. Therefore, the second light emission control driving unit 210-2 may output the second light emission control signal EM[2] having the logic low level and the second carry signal CARRY[2] having the logic high level.

If a time of the start signal ACL_FLM having the logic high level increases by one horizontal time period (1H), the first light emission control driving unit 210-1 may output the first light emission control signal EM[1] having the logic low level at the fourteenth time T14 instead of the twelfth time T12. Therefore, the first light emission control driving unit 210-1 may control the first light emission control signal EM[1] for every horizontal time period (1H) (e.g., the period of the first clock signal EM_CLK1). Similarly, if a time of the start signal ACL_FLM having the logic high level increases by one horizontal time period (1H), the second light emission control driving unit 210-2 and the third light emission control driving unit 210-3 may output the light emission control signals (i.e., the second light emission control signal EM[2] and the third light emission control signal EM[3]) having a high level during the time that increases by one horizontal time period (1H).

As described above, the first light emission control driving unit 210-1 may output the first light emission control signal EM[1] having the logic low level according to a second change (e.g., from the logic high level to the logic low level) of the start signal ACL_FLM. In addition, the first light emission control driving unit 210-1 may output the first carry signal CARRY[1] having the logic low level in response to the first light emission control signal having the logic low level and the first clock signal EM_CLK1 having the logic low level. The second light emission control driving unit 210-2 may shift the first light emission control signal EM[1] by the period of the first clock signal EM_CLK1 (e.g., 1H) in response to the first carry signal CARRY[1], and may output the second light emission control signal EM[2], which is the same as a shifted first light emission control signal EM[1].

As described with reference to FIGS. 4A and 4B, the emission driver 150 according to example embodiments may generate the (n)th light emission control signal EM[n] in response to the (n−1)th carry signal CARRY[n−1], the first clock signal EM_CLK1, and the second clock signal EM_CLK2, and may generate the (n)th carry signal CARRY [n] based on the first clock signal EM_CLK1 and the second clock signal EM_CLK2. Therefore, the emission driver 150 may control the light emission control signals EM[1], EM[3], and EM[3], etc., for one period (e.g., 1H) of the first clock signal EM_CLK1.

The present inventive concept may be applied to any display device (e.g., an organic light emitting display device, a liquid crystal display device, etc.) including an emission driver. For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, and/or the like.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer is referred to as being "between" two elements, it can be the only layer between the two elements, or one or more intervening elements may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept."

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components, such as the timing controller, the scan and data drivers, emission driver, according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the example embodiments of the present invention.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined by the appended claims and equivalents thereof. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims and equivalents thereof. The inventive concept is defined by the following claims, with equivalents of the claims to be included therein.

What is claimed is:

1. An emission driver comprising:

light emission control drivers electrically connected to light emission control lines, the light emission control drivers comprising:

an (n−1)th light emission control driver configured to provide an (n−1)th carry signal, n being an integer greater than or equal to 2; and an (n)th light emission control driver adjacent to the (n−1)th light emission control driver, the (n)th light emission control driver being configured to generate an (n)th light emission control signal for controlling a light emission time of a pixel based on the (n−1)th carry signal, a first clock signal, and a second clock signal, and to generate an (n)th carry signal based on the (n)th light emission control signal, wherein the second clock signal is out of phase from the first clock signal by less than half a period of the first clock signal.

2. An emission driver comprising:

light emission control drivers electrically connected to light emission control lines, the light emission control drivers comprising:

an (n−1)th light emission control driver configured to provide an (n−1)th carry signal, n being an integer greater than or equal to 2; and an (n)th light emission control driver adjacent to the (n−1)th light emission control driver, the (n)th light emission control driver being configured to generate an (n)th light emission control signal for controlling a light emission time of a pixel based on the (n−1)th carry signal, and to generate an (n)th carry signal based on the (n)th light emission control signal, wherein the (n)th light emission control driver comprises:

a first circuit configured to generate the (n)th light emission control signal based on the (n−1)th carry signal, a first clock signal, and a second clock signal having a first phase with respect to the first clock signal, the (n−1)th carry signal having a first period; and a second circuit configured to generate the (n)th carry signal based on the (n)th light emission control signal, the first clock signal, and the second clock signal, wherein the (n)th carry signal is shifted by the first period with respect to the (n−1)th carry signal.

3. The emission driver of claim 2, wherein the first circuit is configured to generate the (n)th light emission control signal by shifting the (n−1)th carry signal by an amount corresponding to the first phase.

4. The emission driver of claim 2, wherein the second circuit comprises:

a first pull-down block configured to store the (n)th light emission control signal at a first node in response to the second clock signal and to pull-down a level of the (n)th carry signal to be equal to that of the first clock signal based on a first voltage at the first node; and a first pull-up block configured to store a low voltage at a second node in response to the second clock signal, and to output the (n)th carry signal having a high voltage based on a second voltage at the second node.

5. The emission driver of claim 4, wherein the first pull-down block comprises:

a first transistor comprising a first electrode configured to receive the (n)th light emission control signal, a second electrode electrically connected to the first node, and a gate electrode configured to receive the second clock signal;

a seventh transistor comprising a first electrode configured to receive the first clock signal, a second electrode electrically connected to an output terminal and configured to output the (n)th carry signal, and a gate electrode electrically connected to the first node; and a first capacitor electrically connected between the first node and the output terminal.

6. The emission driver of claim 5, wherein the first pull-down block further comprises:

a second transistor comprising a first electrode electrically connected to the high voltage, a second electrode electrically connected to a third node, and a gate electrode electrically connected to the second node; and a third transistor comprising a first electrode electrically connected to the third node, a second electrode electrically connected to the first node, and a gate electrode configured to receive the first clock signal.

7. The emission driver of claim 4, wherein the first pull-up block comprises:

a fifth transistor comprising a first electrode electrically connected to the second node, a second electrode electrically connected to the low voltage, and a gate electrode configured to receive the second clock signal;

a sixth transistor comprising a first electrode configured to receive the high voltage, a second electrode electrically connected to an output terminal configured to output the (n)th carry signal, and a gate electrode electrically connected to the second node; and a second capacitor electrically connected between the second node and the high voltage.

8. The emission driver of claim 7, wherein the first pull-up block further comprises:

a fourth transistor comprising a first electrode electrically connected to the second node, a second electrode configured to receive the second clock signal, and a gate electrode electrically connected to the first node.

9. The emission driver of claim 2, wherein the second circuit is the same as the first circuit.

10. The emission driver of claim 2, wherein the first circuit comprises:

a second pull-down block configured to store the (n−1)th carry signal at a fourth node in response to the second clock signal, and to pull-down a voltage level of the (n)th light emission control signal to have a low voltage based on a fourth voltage at the fourth node; and a second pull-up block configured to provide a low voltage to a fifth node in response to the second clock signal, and to output the (n)th light emission control signal having a high voltage based on the first clock signal and a fifth voltage at the fifth node.

11. The emission driver of claim 10, wherein the second pull-up block comprises:

a thirteenth transistor comprising a gate electrode configured to receive the second clock signal, a first electrode configured to receive a low voltage, and a second electrode electrically connected to the fifth node;

a twelfth capacitor electrically connected between the fifth node and a sixth node;

a sixteenth transistor comprising a gate electrode electrically connected to the fifth node, a first electrode configured to receive the first clock signal, and a second electrode electrically connected to the sixth node;

a seventeenth transistor comprising a gate electrode configured to receive the first clock signal, a first electrode electrically connected to the sixth node, and a second electrode electrically connected to a seventh node;

a nineteenth transistor comprising a gate electrode electrically connected to the seventh node, a first electrode configured to receive the high voltage, and a second electrode electrically connected to an output terminal configured to output the (n)th light emission control signal; and a thirteenth capacitor electrically connected between the seventh node and the first electrode of the nineteenth transistor.

12. The emission driver of claim 11, wherein the second pull-up block further comprises:

a twelfth transistor comprising a gate electrode electrically connected to a second node, a first electrode configured to receive the second clock signal, and a second electrode electrically connected to the fifth node; and an eighteenth transistor comprising a gate electrode electrically connected to the second node, a first electrode configured to receive a low voltage, and a second electrode electrically connected to the seventh node.

13. The emission driver of claim 12, wherein the second pull-down block comprises:

an eleventh transistor comprising a gate electrode configured to receive the second clock signal, a first electrode configured to receive the (n−1)th carry signal, and a second electrode electrically connected to the fourth node;

a fourteenth transistor comprising a gate electrode configured to receive the first clock signal, a first electrode electrically connected to the fifth node, and a second electrode electrically connected to the fourth node;

an eleventh capacitor electrically connected between the fourth node and the first clock signal; and a twentieth transistor comprising a gate electrode electrically connected to the fourth node, a first electrode configured to receive the low voltage, and a second electrode electrically connected to an output terminal configured to output the (n)th light emission control signal.

14. The emission driver of claim 13, wherein the eleventh capacitor is a MOS capacitor.

15. The emission driver of claim 14, wherein the eleventh capacitor comprises:

a first electrode electrically connected to the first clock signal;

a second electrode electrically connected to the first clock signal; and a gate electrode electrically connected to the fourth node.

16. A display device comprising:

a display panel comprising light emission control lines and pixels; and an emission driver comprising light emission control drivers electrically connected to the light emission control lines, the light emission control drivers comprising:

an (n−1)th light emission control driver configured to provide an (n−1)th carry signal, n being an integer greater than or equal to 2; and an (n)th light emission control driver adjacent to the (n−1)th light emission control driver, the (n)th light emission control driver being configured to generate an (n)th light emission control signal for controlling a light emission time of the pixels based on the (n−1)th carry signal, and to generate an (n)th carry signal based on the (n)th light emission control signal, wherein the (n)th light emission control driver comprises:

a first circuit configured to generate the (n)th light emission control signal based on the (n−1)th carry signal, a first clock signal, and a second clock signal having a first phase with respect to the first clock signal, the (n−1)th carry signal having a first period; and a second circuit configured to generate the (n)th carry signal based on the (n)th light emission control signal, the first clock signal, and the second clock signal, wherein the (n)th carry signal is shifted by the first period with respect to the (n−1)th carry signal.

17. The display device of claim 16, wherein the second circuit comprises:

a first pull-down block configured to store the (n)th light emission control signal at a first node in response to the second clock signal and to pull-down a level of the (n)th carry signal to be equal to that of the first clock signal based on a first voltage at the first node; and a first pull-up block configured to store a low voltage at a second node in response to the second clock signal and to output the (n)th carry signal having a high voltage based on a second voltage at the second node.

18. The display device of claim 17, wherein the first pull-down block comprises:

a first transistor comprising a first electrode configured to receive the (n)th light emission control signal, a second electrode electrically connected to the first node, and a gate electrode configured to receive the second clock signal;

a seventh transistor comprising a first electrode configured to receive the first clock signal, a second electrode electrically connected to an output terminal and configured to output the (n)th carry signal, and a gate electrode electrically connected to the first node; and a first capacitor electrically connected between the first node and the output terminal.

19. The display device of claim 17, wherein the first pull-up block comprises:

a fifth transistor comprising a first electrode electrically connected to the second node, a second electrode electrically connected to the low voltage, and a gate electrode configured to receive the second clock signal;

a sixth transistor comprising a first electrode configured to receive the high voltage, a second electrode electrically connected to an output terminal configured to output the (n)th carry signal, and a gate electrode electrically connected to the second node; and a second capacitor electrically connected between the second node and the high voltage.

* * * * *